United States Patent [19]

Hvistendahl

[11] Patent Number: 4,734,182

[45] Date of Patent: Mar. 29, 1988

[54] METHOD FOR PRODUCING AN ELECTROLYTIC CELL CATHODE

[75] Inventor: Jan Hvistendahl, Farsund, Norway

[73] Assignee: Mosal Aluminum, Elkem a/s & Co., Norway

[21] Appl. No.: 919,791

[22] Filed: Oct. 16, 1986

[30] Foreign Application Priority Data

Nov. 1, 1985 [NO] Norway ..... 854361

[51] Int. Cl.[4] ..... C25C 3/08; C25C 7/00

[52] U.S. Cl. ..... 204/290 R; 204/294

[58] Field of Search ..... 204/67, 243 R–247, 204/294, 279, 290 R

[56] References Cited

U.S. PATENT DOCUMENTS

| | | | |
|---|---|---|---|
| 2,439,216 | 4/1948 | McLellan | 204/67 X |
| 2,539,743 | 1/1951 | Johnson | 204/244 X |
| 2,958,635 | 11/1960 | Denora | 204/243 R X |
| 3,527,688 | 9/1970 | Giacopelli | 204/294 X |

FOREIGN PATENT DOCUMENTS

| | | | |
|---|---|---|---|
| 596066 | 12/1947 | United Kingdom | 204/243 R |
| 1197903 | 7/1970 | United Kingdom . | |
| 407972 | 4/1974 | U.S.S.R. | 204/243 R |

*Primary Examiner*—Donald R. Valentine

*Attorney, Agent, or Firm*—Lucas & Just

[57] ABSTRACT

The present application relates to an outer shell for electrolytic cell for molten salt electrolysis preferably an electrolytic cell for production of aluminium, wherein the outer shell is made from concrete.

The present application further relates to a method for producing a cathode for molten salt electrolysis where the cathode is built up on a form having outer dimensions and shape corresponding to the inner dimensions and shape of the finished cathode, by successively placing on said form bottom carbon blocks, eventual intermediate carbon blocks, sidewall carbon blocks, busbars, and eventual barrier layer and refractory insulation material layers, whereafter an outer shell made from concrete is cast upon the layers of refractory insulation material.

21 Claims, 2 Drawing Figures

METHOD FOR PRODUCING AN ELECTROLYTIC CELL CATHODE

Figure 1:
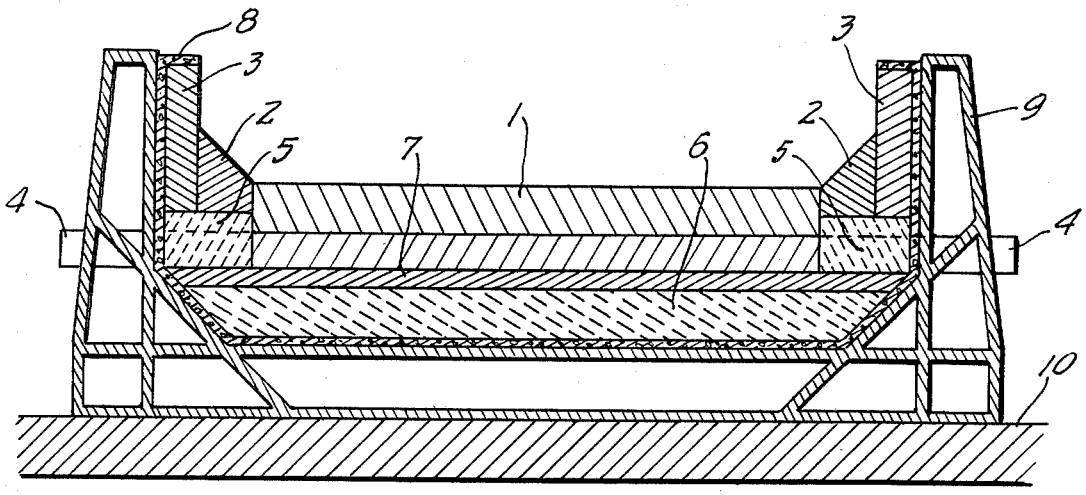

The present invention relates to a new outer shell for electrolytic reduction cells for molten salt electrolysis particularly to outer shells for electrolytic reduction cells for production of aluminium. The present invention further relates to a method for producing an electrolytic reduction cell cathode.

According to the state of art electrolytic cell cathodes for production of aluminium comprise an outer open-top steel shell. On the inside of said steel shell there is provided a lining consisting of a refractory insulation layer, a carbonaceous bottom lining with busbars and a layer of prebaked and/or monolithic rammed carbon on the sidewalls.

In use the outer steel shell of the cathode becomes deformated due to thermal and mechanical stress. The lining of the cathode must be replaced after an operation time which normally is between 1 and 6 years. The lining is removed from the steel shell and is deponated, while the outer steel shell, which is very costly normally is re-used after a costly reparation. Even after the steel shells have been repaired they will still be deformated and have reduced tolerance and mechanical stress will be introduced in the steel shells.

This implies that by relining of a cathode based on a repaired steel shell, it is very difficult to achieve a good fitment between the outer steel shell and the new lining. The quality of a cathode which is built up on the basis of a repaired steel shell will thereby on the average be lower than for a cathode based on a new steel shell. This reduced quality of the cathodes may lead to operation difficulties and a shorter lifetime for the reduction cell.

When using an outer steel shell the assembling of the different parts of the lining and the busbars must be done inside the steel shell. It is thereby necessary to work inside a rather narrow steel box.

This way of assembling the cathode makes it difficult to adjust the individual carbon blocks for the sidewalls and the bottom in correct relation to each other, resulting in a need to join the carbon blocks by using tamping paste which normally is based on a carbonaceous material. Use of tamping paste is, however, undesireable as cracks have a tendency to develop when the paste is baked, and components of the molten electrolytic bath may thereby, during operation of the electrolytic cell, penetrate down through the lining and thereby destroy the lining. In order to obtain a best possible durability of the carbon lining it is therefore preferred to use a completely monolithic lining. For the above reasons, this is not possible to achieve when the lining has to be mounted inside a steel shell. The known methods therefore are restricted to monolithic joining of the carbon blocks in the bottom lining.

The outer steel shell further limit a free expansion of the lining. Such expansion occurs due to chemical and thermal processes in the carbon blocks during operation of the cell. The restriction of the expansion of the lining is probably an origin for cracks in the carbon lining which reduces the lifetime of the lining.

Assembling of the lining inside the steel shell makes it difficult to mechanize the assembling process, as a greater part of the work has to be done manually. This substantially increases the costs of the assembling operation.

It is an object of the present invention to provide an outer shell for electrolytic reduction cells for molten salt electrolysis and a method of producing a cathode for such electrolytic reduction cells which makes it possible to overcome the above mentioned drawbacks and disadvantages of electrolytic cells where an outer steel shell is used.

Accordingly the present invention relates to an outer shell for an electrolytic reduction cell for molten salt electrolysis, preferably an electrolytic cell for production of aluminium, wherein the outer shell is made from concrete.

The outer shell can be produced from any known concrete which is stable at the temperature the outer shell is exposed to during ordinary operation of the electrolytic reduction cell.

According to a preferred embodiment of the present invention the outer shell is made from a refractory concrete such as a concrete based on alumina cement with a refractory filler.

According to another embodiment of the present invention the outer shell is made wholly or partly of reinforced concrete. As reinforcement ordinary steel reinforcement or fibers such as for example steel fibers or carbon fibers can be used.

According to yet another embodiment of the present invention the outer shell is made from a concrete composite material comprising at least two layers of concrete having different compositions and properties. Further, concrete having different compositions and properties can be used in the bottom and the sidewalls of the outer shell.

The present invention also relates to a method for producing an electrolytic reduction cell cathode for molten salt electrolysis, particularly an electrolytic reduction cell cathode for production of aluminium, wherein the cathode is built up on form having outer dimensions and shape corresponding to the inner dimensions and shape of the finished cathode, by successively placing on said form bottom carbon blocks, sidewall carbon blocks, eventual intermediate carbon blocks, busbars, barrier layer and layers of refractory insulating material, whereafter an outer shell made from concrete is cast upon the layers of refractory insulation by spraying. After curing of the concrete, the finished cathode is departed from the form.

According to an embodiment of the method of the present invention, a carrying frame is mounted about the outer shell before the concrete has been cured. A good fitment is thereby achieved between the frame and the outer shell.

In order to obtain a monolithic carbon lining, it is preferred to glue all of the carbon blocks together during the assembling. This will give a monolithic lining which will reduce the possibility of penetration of molten electrolyte and metal and thereby prevent floating and deformation of the bottom carbon blocks.

By the method according to the present invention the production process for the cathode is substantially simplyfied compared to the known methods for production of cathodes for this kind of electrolytic cells, as the production process is easy to mechanize. As the assembling of the cathode starts with the carbon lining, a very accurate fitment is achieved between each of the carbon blocks in the lining. This gives a very dense and mechanical strong construction without the need of using tamping paste. Finally a good fitment between the outer shell and the lining is achieved as the outer shell is made by casting concrete directly on the lining.

By the invention according to the present application it is obtained a high degree of freedom to change the geometrical form of the cathode, such as length, width height etc. The sidewalls can to a certain degree be made plastic in order to reduce the forces which acts on the carbon lining when it expands during operation of the electrolytic cell. In addition the cross-section of the busbars and the number of busbars can be choosen much more freely than according to the known way of producing cathodes for electrolytic cells.

By replacement of cathodes which have been produced by the method according to the present invention no concern has to be paid to the outer concrete shell as the cathode including the outer shell made from concrete is deponated. This means that the cathodes can be replaced in much shorter time than according to the known method, where it is necessary to adjust the carrying frame to the outer steel shell, as all repaired outer steel shells will have different dimensions.

The outer shell made from concrete in accordance with the present invention, is substantially less costly than outer shells made from steel. Together with the more simply method of producing the cathodes, the cathodes according to the present invention can be produced at a substantially lower cost than the known cathodes.

Figure 2:
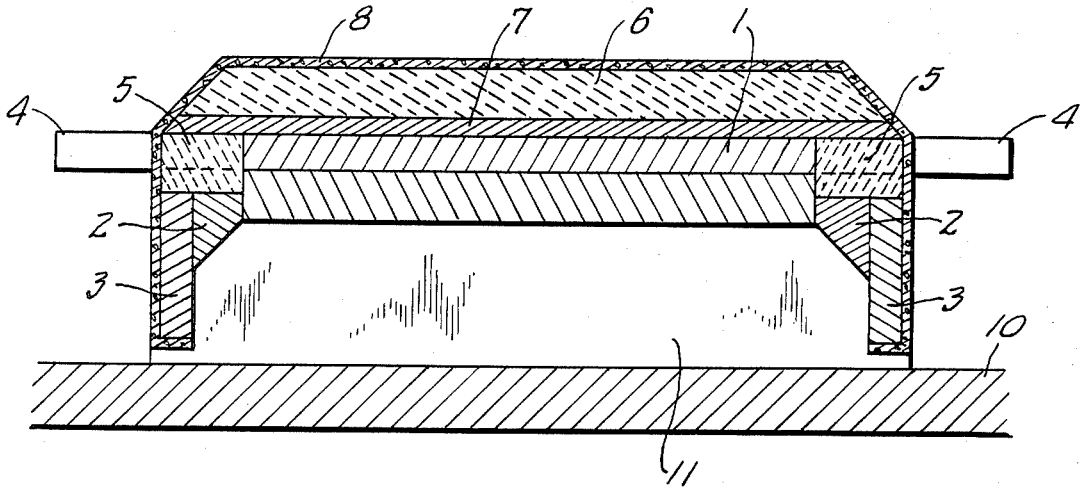

The present invention will now be further described in connection with the drawings which show an embodiment of the present invention wherein;

FIG. 1 shows a vertical cross-sectional view of a finished cathode mounted in a carrying frame, and FIG. 2 shows a vertical cross-sectional view of a finished cathode before it is departed from the form.

On FIG. 1 there is shown a finished cathode for an electrolytic cell for production of aluminium. The cathode comprises bottom carbon blocks 1, intermediate carbon blocks 2, sidewall carbon blocks 3, busbars 4, refractory insulation material layers 5, 6, a barrier layer 7 and an outer shell 8 made from concrete. The cathode is mounted in a carrying frame 9 which rests on a floor 10.

A preferred method for producing a cathode for electrolytic cells for production of aluminium will now be described in connection with FIG. 2.

On a form 11 having outer dimensions and shape equal to the inner dimensions and shape of the finished cathode, the bottom carbon blocks 1 are mounted by connecting the carbon blocks 1 to each other by glue. Thereafter the intermediate carbon blocks 2 are mounted, the intermediate carbon blocks 2 being connected to each other and to the bottom carbon blocks 1 by glue. Finally the sidewall carbon blocks 3 are mounted, the sidewall carbon blocks 3 being connected to each other and to the intermediate carbon blocks 2 by glue. In this way a completely dense, monolithic carbon lining is obtained. The bottom carbon blocks 1, the intermediate carbon blocks 2 and the sidewall carbon blocks 3 are preshaped in order to achieve best possible fitment between the individual carbon blocks when they are mounted.

The busbars 4 may either be connected to the bottom carbon blocks 1 before the bottom carbon blocks 1 are placed on the form 11 or after the bottom carbon blocks 1 are placed on the form 11. As the busbars 4 do not have to extend through openings in an outer steel casing as in accordance with the known method, the problems that exist by mounting bottom carbon blocks with busbars inside a steel shell are completely overcome. When the carbon lining is finished, the refractory insulation material layer 5 is put in place. The barrier layer 7 can now be mounted with good fitment against the bottom carbon blocks 1, whereafter the bottom refractory insulation layer 6 is placed upon the barrier layer 7. The outer concrete shell 8 is now produced preferably by spraying of the concrete.

After curing of the concrete, the finished cathode is departed from the mould 11.

What is claimed:

1. A method for producing an electrolytic cell cathode wherein said cell cathode has an inner cell area formed by a bottom area and a side area, said method comprising the steps of:

(a) first, forming a layer of carbon material onto a form, said form having outer dimenisons and shape comparable to said inner cell area said layer of carbon material having a bus bar;

(b) second, placing over at least a portion of said layer of carbon material a refractory insulating material to form a shell; and (c) third, casting concrete over said shell thereby forming said electrolytic cell cathode.

2. The method of claim 1 wherein said layer of carbon material is formed onto said form by placing preformed carbon blocks onto said form and gluing together said preformed carbon blocks to form a monolithic carbon lining.

3. The method of claim 2 wherein said bus bar is part of said carbon blocks prior to forming said layer of carbon material on said form.

4. The method of claim 2 wherein said bus bar is provided to said carbon blocks after forming said layer of carbon material on said form.

5. The method of claim 1 wherein said concrete is cast onto said shell by spraying.

6. The method of claim 1 further comprising the step of mounting a carrying frame onto said concrete prior to said concrete fully curing.

7. The method of claim 1 further comprising the step of placing a barrier layer onto at least a portion of said layer of carbon material.

8. A method for producing an electrolytic cell cathode, wherein said electrolytic cell cathode has an inner cell area formed by a bottom area and a side area, said method comprising the steps of:

(a) first, forming a monolithic carbon layer onto a form, said form having outer dimensions and shape comparable to said inner cell area, said carbon layer having a bus bar;

(b) second, placing over at least part of said monolithic carbon layer refractory insulating material to form a shell; and (c) third, casting over said shell a concrete material thereby forming said electrolytic cell cathode.

9. The method of claim 8 wherein said monolithic carbon layer is formed by gluing preformed carbon blocks together.

10. The method of claim 9 wherein said concrete is cast onto said shell by spraying.

11. The method of claim 10 further comprising the step of mounting a carrying frame onto said concrete prior to said concrete fully curing.

12. The method of claim 11 further comprising the step of placing a barrier layer onto at least a portion of said layer of carbon.

13. A method of producing an electrolytic cell cathode wherein said cell has an inner cell area formed from a bottom area and a side area, said method comprising the steps of:

(a) first, forming a monolithic carbon layer from carbon blocks, said carbon layer having an inside and an outside, said inside having an area comparable to said inner cell area, said monolithic carbon layer having a bus bar;

(b) second, placing over said outside of said monolithic carbon layer at least a partial layer of refractory material to form a shell; and (c) third, casting concrete over said shell thereby forming said electrolytic cell cathode.

14. The method of claim 13 further comprising the step of placing a barrier layer onto at least a portion of said carbon material prior to casting said concrete.

15. The method of claim 14 further comprising the step of mounting a carrier frame onto said concrete prior to said concrete fully curing.

16. The method of claim 15 wherein said concrete is cast onto said shell by spraying.

17. An electrolytic cell cathode wherein said cell cathode has an inner cell area formed by a bottom area and a side area, said cell cathode being characterized by being made by a method comprising the following steps:

(a) first, forming a monolithic carbon layer from carbon blocks onto a form, said form having outer dimensions and shape comparable to said inner cell area, said carbon layer having a bus bar;

(b) second, placing over at least part of said monolithic carbon layer refractory insulating material to form a shell; and (c) third, casting over said shell a concrete material thereby forming said electrolytic cell cathode.

18. The electrolytic cell cathode of claim 17 wherein said concrete is concrete based on a refractory cement.

19. The electrolytic ce11 cathode of claim 17 wherein said concrete is at least partially reinforced concrete.

20. The electrolytic cell cathode of claim 19 wherein said reinforced concrete is fiber-reinforced concrete.

21. The electrolytic cell cathode of claim 17 wherein said concrete is a composite concrete comprising at least two layers of concrete having different compositions and properties.

* * * * *